US007857368B2

(12) United States Patent
Duke

(10) Patent No.: US 7,857,368 B2
(45) Date of Patent: Dec. 28, 2010

(54) RAIN GUTTER CLEANING TONGS

(76) Inventor: David Duke, 20828 Jack Tone Rd., Ripon, CA (US) 95366

( * ) Notice: Subject to any disclaimer, the term of this patent is extended or adjusted under 35 U.S.C. 154(b) by 405 days.

(21) Appl. No.: 11/076,685

(22) Filed: Mar. 10, 2005

(65) Prior Publication Data

US 2006/0201067 A1 Sep. 14, 2006

(51) Int. Cl.
*A47G 21/10* (2006.01)
*A47J 43/28* (2006.01)

(52) U.S. Cl. ..... 294/16; 294/99.2

(58) Field of Classification Search ..... 294/99.2, 294/16, 3, 7; 30/120.1, 123.6, 123.7; 15/236.04; D7/686, 687
See application file for complete search history.

(56) References Cited

U.S. PATENT DOCUMENTS 1,411,316 A * 4/1922 Vestal ..... 294/50.8
D138,917 S * 9/1944 Frank ..... D7/686
2,545,794 A * 3/1951 Roberts et al. ..... 294/7
D194,113 S * 11/1962 Page ..... D7/686
D221,348 S * 8/1971 Myer et al. ..... D7/686
D258,110 S * 2/1981 Lamberth ..... D7/686
6,536,819 B2 * 3/2003 Wang et al. ..... 294/16

* cited by examiner

*Primary Examiner*—Paul T Chin
(74) *Attorney, Agent, or Firm*—Rick Martin; Patent Law Offices of Rick Martin, P.C.

(57) ABSTRACT

Rain gutter and downspout cleaning tongs. The rain gutter cleaning tongs include a pair of arms, each having a distal portion and a proximal portion that are arranged at obtuse angles relative to each other. A gripping head is located at a distal end of the distal portion of each arm. The proximal arm portions are pivotally attached to each other and are spring loaded to bias their gripping surfaces away from each other. Optionally, a guide is attached to one of the arms for guiding the two arms relative to each other during operation.

4 Claims, 4 Drawing Sheets

RAIN GUTTER CLEANING TONGS

BACKGROUND

This invention relates to the area of rain gutter and down spout cleaning devices, and more particularly to rain gutter and downspout cleaning tongs.

The use of rain gutters to re-channel rain water from roof eaves is now fairly widespread. However, oftentimes homeowners and businesses neglect to properly clean out the rain gutters and downspouts of leaves, dirt and other debris which can cause the rain gutters to clog, and work inefficiently or not at all. Sometimes, debris will flow through the horizontal rain gutters and clog downspouts causing a backup of the rain water in the horizontal gutters.

Various tools are presently available to clean out rain gutters, including a variety of scraping tools and shovel-like implements for removing the debris. However, in the case of scraper implements, these implements simply accomplish scraping debris off of the bottoms and/or sides of rain gutters, pushing the debris to another location in the rain gutter and/or loosening up the debris, leaving the debris to be picked up and collected later. In the case of shovel-like scooper tools, if too much is attempted to be picked up in one shovel full, the debris will sometimes fall out. Moreover, these scraper-like tools and shovel tools are not very useful for cleaning out downspouts. Accordingly, there remains a need for a tool for cleaning rain gutters and downspouts which allows for the faster and more efficient removal of debris from the rain gutter and downspouts.

SUMMARY OF THE INVENTION

The invention provides a rain gutter cleaning tong having two gripping heads which extend from obtuse angled articulating arms. The arms are preferably spring loaded and the gripping surfaces are preferably adapted to capture debris in a pinching motion when the two obtuse angled arms are brought together. The front edge of the gripping heads can be flat to permit the gutter to be scraped while debris is being removed.

In order to ensure proper alignment of the two arms during operation, an arm guard can be affixed to one of the arms to maintain a parallel alignment of the arms during operation.

The rain gutter cleaning tongs can be formed of a strong material such as steel, aluminum or strong plastic. Other materials could also be used such as composite materials or even wood.

DETAILED DESCRIPTION OF THE INVENTION

Figure 1:
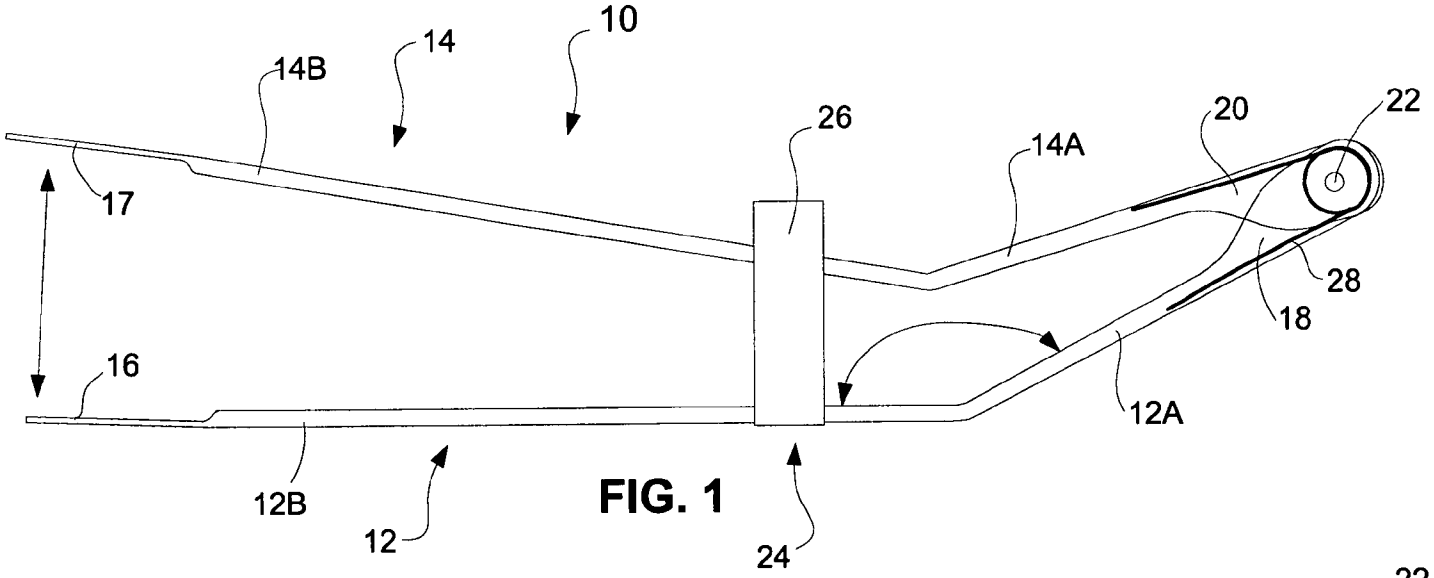
FIG. 1 is a side view of an exemplary embodiment of the rain gutter cleaning tongs in an open position.
Figure 2:
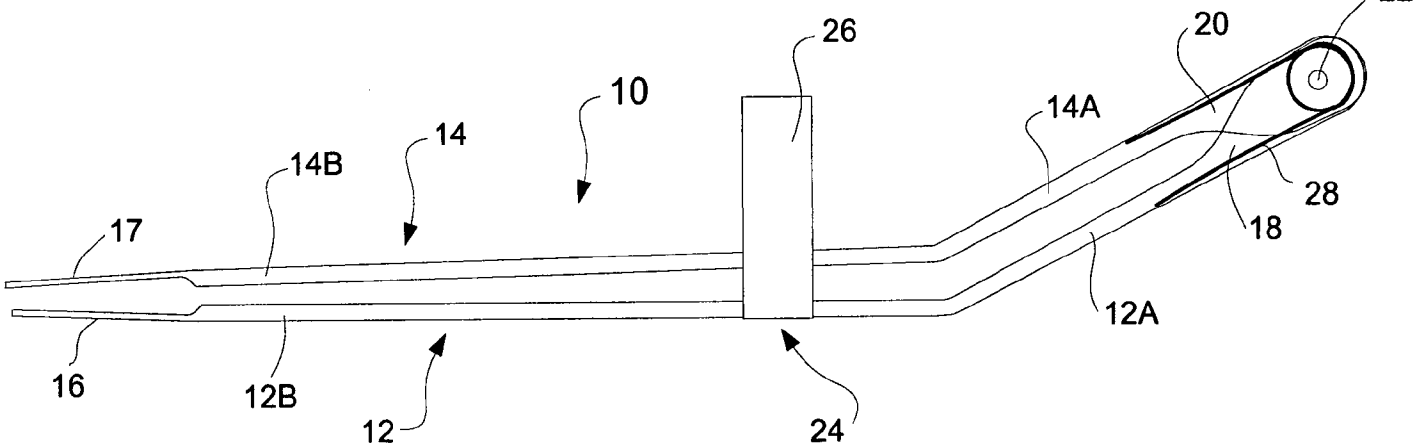
FIG. 2 is a side view of the rain gutter cleaning tongs of FIG. 1, but in a closed position.

Referring now to the figures, FIG. 1 is a side view of an exemplary embodiment of a pair of rain gutter cleaning tongs 10. The rain gutter cleaning tongs has two arms 12 and 14 which have at their distal ends gripping heads 16 and 17, respectively. Arms 16 and 17 are connected at their proximal ends 18 and 20, respectively, by a pivot 22. The two arms 12 and 14 are preferably spring loaded. An optional arm guide 24 is mounted to one of the arms, e.g., arm 12, and has a guide wall 26 which guides the movement of the arms in a parallel relationship relative to each other. Each of the arms 12 and 14 have two sections 12*a* and 12*b*, and 14*a* and 14*b*, respectively, which are in obtuse angular relationship with respect to each other. The obtuse angular relationship of the two sections of the arms 12*a* and 12*b* and 14*a* and 14*b* is important since the proximal sections of the arms 12*a* and 14*a* provide an upwardly angled grip portion where a user can squeeze these two sections 12*a* and 14*a* together to cause the gripping heads 16 and 17 on distal arm portion 12*b* and 14*b*, respectively, to be brought together, which is best shown in FIG. 2. This takes place while, for example, the distal arm portion 12*b* is used to scrape the bottom of the gutter. The lower arm 12 to which the arm guide 24 is attached will, in use, be the lower arm which is placed in contact with the gutter. Again, by simply bringing the two arms together, debris can be grasped and picked up and removed from the rain gutter and/or the downspout. Again, the proximal portions 12*a* and 14*a* are important since they allow users to operate the rain gutter cleaning tongs without placing the users hand in the gutter. The angle $\alpha$ between the distal and proximal parts is between about 100 and 170 degrees and more preferably between about 135 to about 160 degrees, depending on the relative lengths of the proximal and distal portions of the arms 12 and 14.

Figure 3:
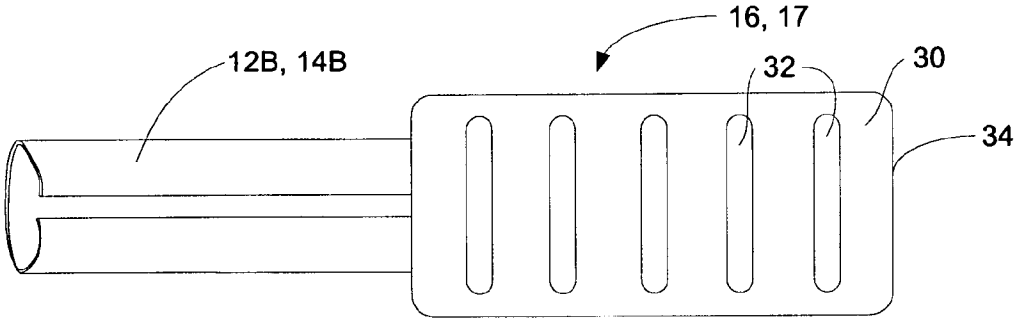
FIG. 3 is a top plan detail showing an exemplary embodiment of a gripping head.

Referring to FIG. 3, there is shown a first exemplary embodiment of gripping heads 16 and 17. In the first exemplary embodiment, the gripping heads 16, 17 comprise a generally flat and rectangular plate 30 and is shown with optional protrusions 32 formed thereon for providing a better grip with the debris being captured. A front edge 34 is preferably relatively straight and can be used for scraping the bottom and/or sides of the rain gutter.

Figure 4:
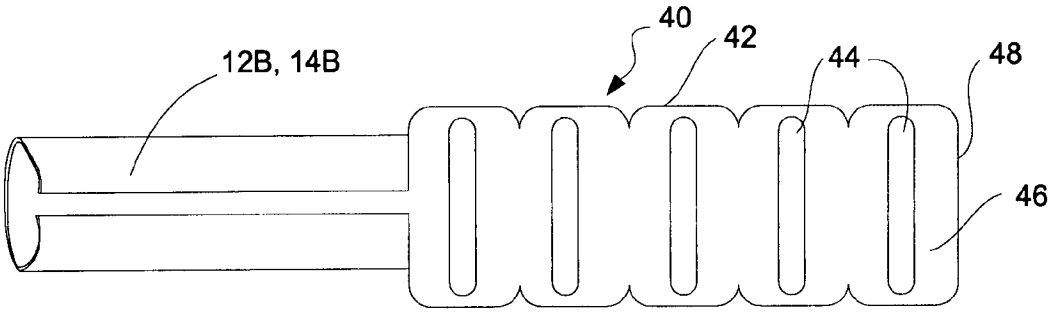
FIG. 4 is a top plan view of another exemplary embodiment of the cleaning tong gripping heads.

Referring to FIG. 4, there is shown a second exemplary embodiment of a gripping head 40 of the rain gutter cleaning tongs which has scalloped edges 42 and is also shown with optional gripping protrusions 44 extending from a generally flat plate 46. As with the first embodiment of the gripping head, a relatively flat front 46 may be provided at a front of the gripping surface. The gripping head 40 extends from the distal end of the arms 12*b* and 14*b* and can be preferably be formed together therewith.

Figure 5:
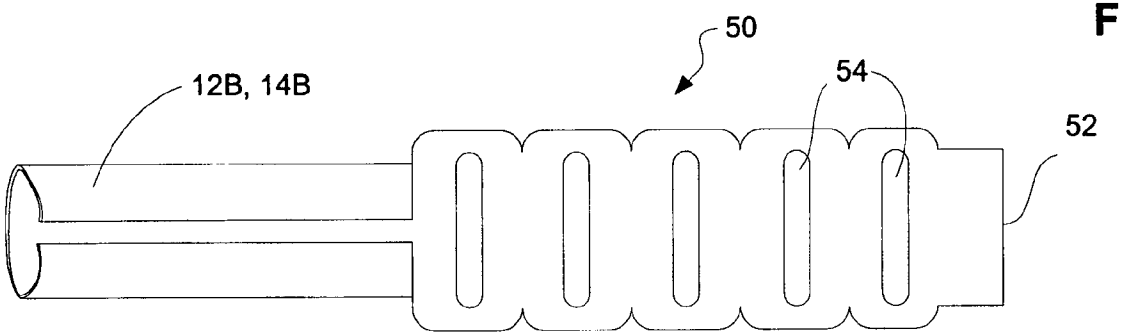
FIG. 5 is a top plan view of a yet another exemplary embodiment of the rain gutter cleaning tongs gripping heads.

Referring now to FIG. 5, there is shown a third exemplary embodiment of the gripping head 50 of the rain gutter cleaning tongs. This embodiment is similar to that shown in FIG. 4 except it has an extension portion 52 at a leading edge thereof. As with other embodiments, optional protrusions 54 can be located on the gripping head to provide for better gripping action on debris and the gripping surface 52 can extend from the distal ends 12*b* and 14*b* of the arms.

The gripping heads 16, 17, 40, 50 may also be shaped to include concavities, or to be curved if desired.

Figure 6:
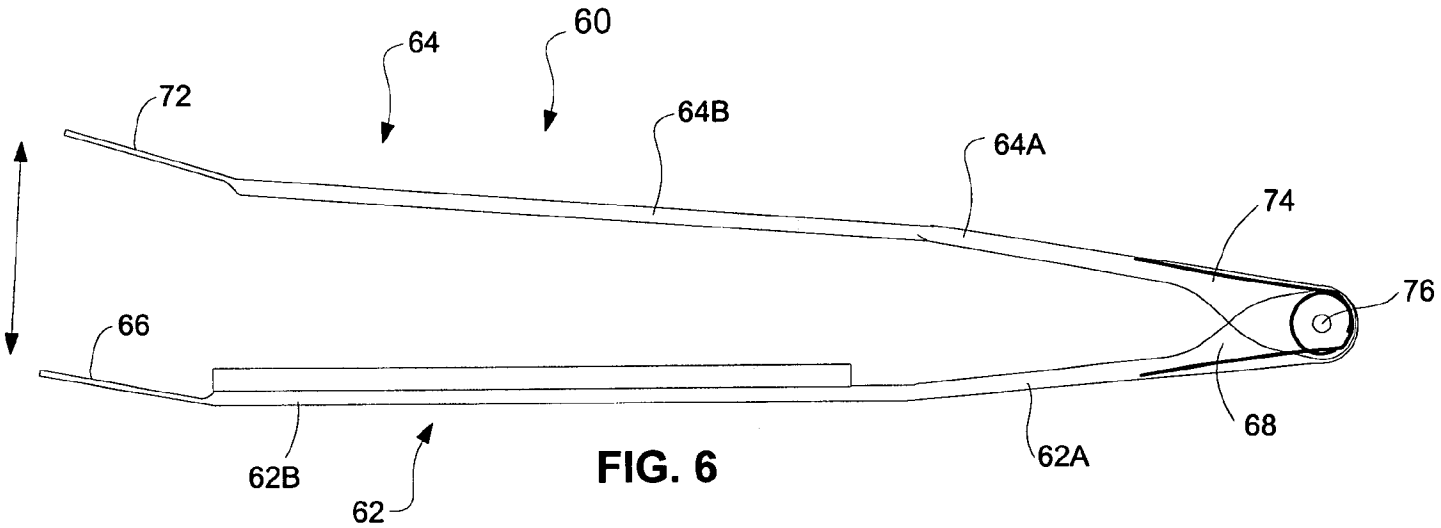
FIG. 6 is a side view of another exemplary embodiment of the rain gutter cleaning tongs of the invention in an open position.

FIG. 6 is a side view of another exemplary embodiment of the rain gutter cleaning tongs 60 of the invention in an open position. This embodiment has a lower arm portion 62 and an upper arm portion 64. The lower arm portion 62 has a proximal portion 62A and a distal portion 62B, with the proximal portion 62A angled slightly upwardly from the distal portion 62B. A gripping head 66 is provided at the distal portion 62B and can, if desired, be slightly angled up from the distal portion 62B. A debris tray 70 is provided on the upper surface of the distal portion 62B and functions to carry additional debris. Alternately, the debris tray 70 can be integrated into the shape of the arm portion 62. The proximal portion 62B has a pivot end 68. The upper arm portion 64 has a proximal portion 64A and a distal portion 65B, with the proximal portion 62A angled slightly downwardly from the distal portion 64B. A gripping head 72 is provided at the distal portion 64B and can, if desired, be slightly angled down from the distal portion 64B. The proximal portion 64B has a pivot end 74 which connects to the pivot end 68 of the lower arm 62 by a pivot 76. A spring 78 biases the lower and upper arms away from each other.

Figure 7:
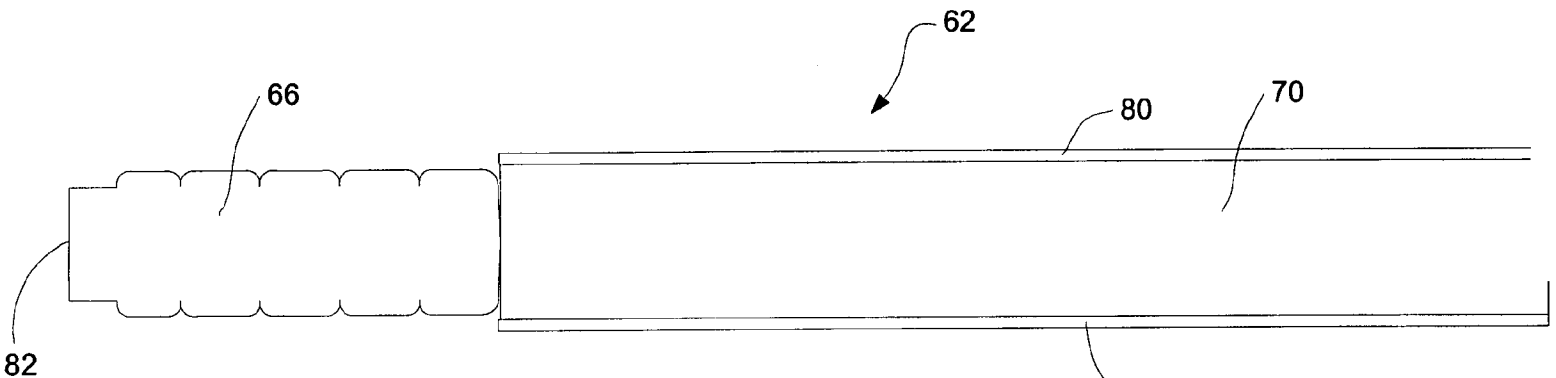
FIG. 7 is a detail of a portion of the lower arm of the rain gutter cleaning tong of FIG. 6.

FIG. 7 is a detail of a portion of the lower arm 62 of the rain gutter cleaning tong 60 of FIG. 6, showing the debris tray 70 on the lower arm 62. The debris arm 70 can optionally have low rising walls 80 for added strength and gripping action. Although the tray is shown as being relatively flat, it can have other shapes and contours. The gripping head 66 has an appearance similar to that shown in FIG. 5, e.g. with a shovel tip 82 and is shown without optional protrusions 54. If desired, the gripping head 66 can have other shapes, can be cupped, etc.

Figure 8:
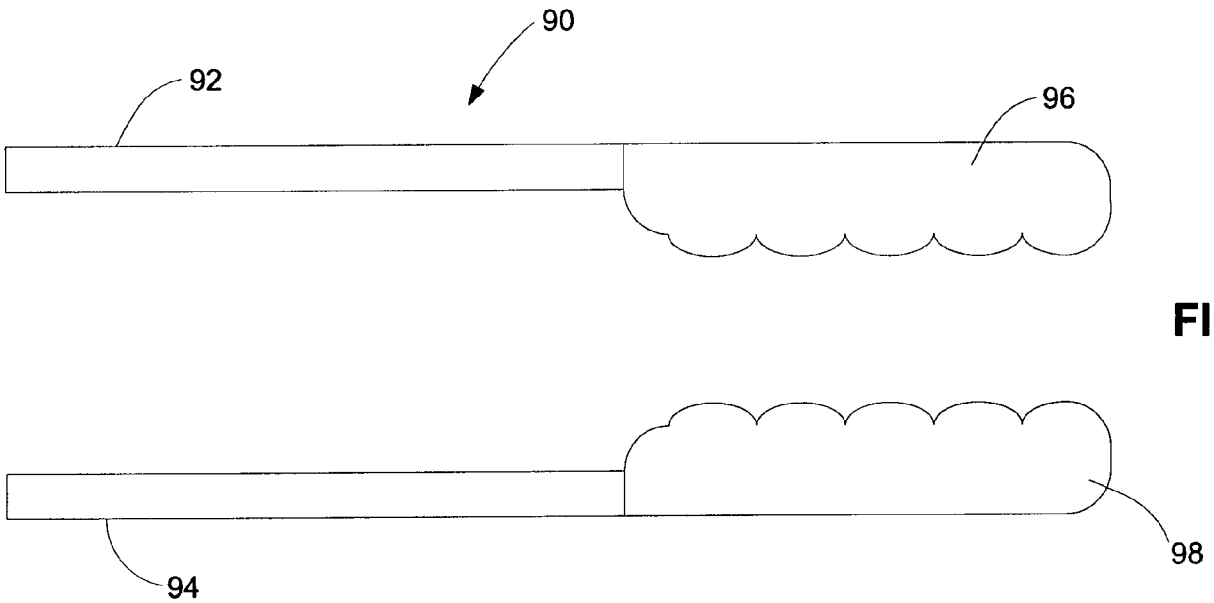
FIG. 8 is a partial side of another exemplary embodiment of the rain gutter cleaning tongs of the invention particularly adapted for cleaning rain gutter downspouts.

FIG. 8 is a partial side of another exemplary embodiment of the rain gutter cleaning tongs 90 of the invention particularly adapted for cleaning rain gutter downspouts. These tongs have arms 92 and 94, with gripping heads 96 and 98, respectively, having inwardly facing profiles that are adapted for inserted into an opening of a rain gutter downspout.

Figure 10:
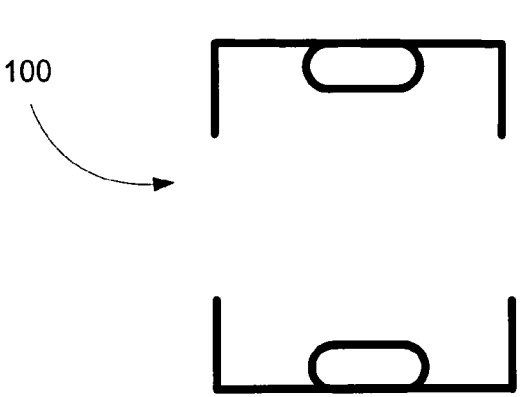
FIG. 10 is a front view of another head design of the gutter cleaning tongs of FIG. 8.
Figure 9:
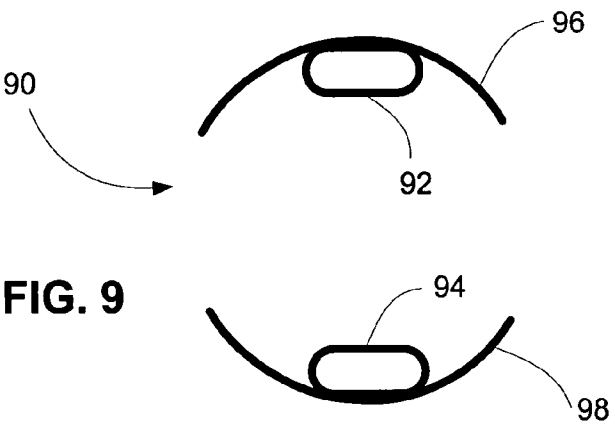
FIG. 9 is a front view of the exemplary rain gutter cleaning tongs of FIG. 8.

FIG. 9 is a front view of the exemplary rain gutter cleaning tongs 90 of FIG. 9, and shown the gripping heads 96 and 98, respectively, as being arc-shaped with their concavities facing each other. Alternately, the gripping heads can be generally U-shaped, or have other shapes with inwardly facing concavities that face each other that permit the tongs to be fix down into an opening of rain gutter downspout to pull out debris from therein, such as the U-shaped heads 100 shown in FIG. 10.

It is to be understood that the invention is not limited in its application to the details and construction and arrangements of the components set forth in the above description or illustrations and drawings. The invention is capable of other embodiments that are being practiced and carried in various ways. It also is to be understood that the phraseology and terminology employed herein is for the purpose of description and should not be regarded as limiting.

What is claimed is:

1. Rain gutter cleaning tongs, comprising:

a pair of arms, each arm having an elongate distal portion and a shorter proximal portion that are arranged relative to each other at an obtuse angle, wherein the pair of arms are pivotally attached to each other at their proximal portions with the obtuse angles generally facing each other, the distal portions having generally flat and wide profiles, a lower arm having at least two rising walls, one at each outbound edge, around at least a portion of each distal portion and positioned substantially 90 degrees from each distal portion that are generally opposite each other and are adapted to capture debris therebetween when the pair of arms are brought together;

a spring for spring loading the pair of arms;

said shorter proximal portion of each arm having a width about the same as a width of the elongate distal portion;

each arm member having the same width;

a distal tip of each shorter proximal portion of each arm having a straight edge 90° relative to a longitudinal axis of the arms and having a smaller width than the elongate distal portion;

a lower arm shorter proximal portion angled slightly upward from its elongate distal portion;

an upper arm shorter proximal portion angled slightly upward from its elongate distal portion so as to be parallel to the lower arm shorter proximal portion; and each of said shorter proximal portions having a planar shape without any holes.

2. The rain gutter cleaning tongs of claim 1, wherein the pair of arms are formed of high strength material selected from the group consisting of steel, aluminum, plastic, composite materials and wood.

3. The rain gutter cleaning tongs of claim 1, wherein the upper and the lower elongate distal portions of the arms are slightly angled toward each other at a proximal end of each.

4. The rain gutter cleaning tongs of claim 1, wherein said shorter proximal portion of each arm has a pair of scalloped outside edges.

* * * * *